US009812072B2

(12) United States Patent
Cho et al.

(10) Patent No.: US 9,812,072 B2
(45) Date of Patent: Nov. 7, 2017

(54) DISPLAY DEVICE

(71) Applicant: SAMSUNG DISPLAY CO., LTD., Yongin-Si, Gyeonggi-Do (KR)

(72) Inventors: Hyunmin Cho, Seoul (KR); Jonghyuk Kang, Suwon-si (KR); Daehyun Kim, Hwaseong-si (KR); Jaebyung Park, Seoul (KR); Jinseob Byun, Seoul (KR); Hyundeok Im, Seoul (KR); Keun-tae Jung, Yongin-si (KR); Sung-jin Hong, Hwaseong-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 15/133,630

(22) Filed: Apr. 20, 2016

(65) Prior Publication Data

US 2017/0053605 A1 Feb. 23, 2017

(30) Foreign Application Priority Data

Aug. 17, 2015 (KR) ..... 10-2015-0115534

(51) Int. Cl.
*G09G 5/10* (2006.01)
*G09G 3/34* (2006.01)

(52) U.S. Cl.
CPC ... *G09G 3/3413* (2013.01); *G09G 2300/0452* (2013.01); *G09G 2310/0235* (2013.01)

(58) Field of Classification Search
CPC ..... G09G 3/20; G09G 3/2003; G09G 3/30; G09G 3/3208; G09G 3/34; G09G 3/3413; G09G 3/342; G09G 5/10; G09G 2310/0235; G09G 2320/0242; G09G 2320/043; G09G 2320/0666; G09G 2340/06
See application file for complete search history.

(56) References Cited

U.S. PATENT DOCUMENTS 8,736,641 B2 5/2014 Byun et al.
8,913,213 B2 * 12/2014 Kim ..... G02F 1/133603 349/69
2008/0074583 A1 * 3/2008 Li ..... G02F 1/133617 349/71

(Continued)

FOREIGN PATENT DOCUMENTS

KR 20030056350 A 7/2003
KR 20070058417 A 6/2007

(Continued)

OTHER PUBLICATIONS

Kirk Smick et al., Blue light hazard : New Knowledge, New Approaches to Maintaining Ocular Health, Report, Mar. 16, 2013, 12 pages, Essilor of America, New York City, NY, USA.

(Continued)

*Primary Examiner* — Joe H Cheng
(74) *Attorney, Agent, or Firm* — Cantor Colburn LLP

(57) ABSTRACT

A display device includes a driving unit which outputs a driving signal, and a display panel which displays an image with at least red light, green light, and blue light in response to the driving signal where the blue light includes first color light and second color light, and a peak wavelength of the first color light is about 390 nanometers (nm) to about 410 nm and a peak wavelength of the second color light is about 480 nm to about 491 nm.

20 Claims, 15 Drawing Sheets

(56) References Cited

U.S. PATENT DOCUMENTS

| | | | | |
|---|---|---|---|---|
| 2010/0208041 | A1* | 8/2010 | Savvateev | G02B 27/2207 348/51 |
| 2012/0155060 | A1* | 6/2012 | Ninan | G02B 27/2264 362/84 |
| 2012/0250351 | A1* | 10/2012 | Shin | G02F 1/133603 362/608 |
| 2013/0140535 | A1* | 6/2013 | Chu | H01L 51/5203 257/40 |
| 2015/0227002 | A1* | 8/2015 | Won | G09G 3/3413 349/68 |
| 2016/0253954 | A1* | 9/2016 | Yang | G09G 3/3208 345/690 |

FOREIGN PATENT DOCUMENTS

| | | | |
|---|---|---|---|
| KR | 20070110251 | A | 11/2007 |
| KR | 20090118431 | A | 11/2009 |
| KR | 20120002782 | A | 1/2012 |
| KR | 20130047909 | A | 5/2013 |
| KR | 1020140142417 | A | 12/2014 |
| KR | 20150005378 | A | 1/2015 |

OTHER PUBLICATIONS

Philips Monitors, Monitors 2014/2015—The accents Philips Display Solutions, 2014, 24 pages, Koninklijke Philips N.V.

* cited by examiner

DISPLAY DEVICE

This application claims priority to Korean Patent Application No. 10-2015-0115534, filed on Aug. 17, 2015, and all the benefits accruing therefrom under 35 U.S.C. §119, the content of which in its entirety is herein incorporated by reference.

BACKGROUND

Exemplary embodiments of the invention herein relate to a display device.

In general, a display device may display an image by using red light, green light, and blue light.

SUMMARY

Blue light is essential to detect color in a display device, but strains viewer's eyes when emitted to the eyes for a long time.

The invention provides a display device for reducing strain to eyes and maintaining display quality.

An exemplary embodiment of the invention provides a display device includes: a driving unit which outputs a driving signal, and a display panel which displays an image by using at least red light, green light, and blue light in response to the driving signal, wherein the blue light includes first color light and second color light, and a peak wavelength of the first color light is about 390 nanometers (nm) to about 410 nanometers (nm) and a peak wavelength of the second color light is about 480 nm to about 491 nm.

In an exemplary embodiment, a half width of the first color light may be about 17 nm to about 25 nm.

In an exemplary embodiment, a half width of the second color light may be about 17 nm to about 23 nm.

In an exemplary embodiment, the display device may further include a light source unit disposed under the display panel and providing light to the display panel.

In an exemplary embodiment, the light source unit may include a first light source for emitting the red light, a second light source for emitting the green light, and a third light source for providing the blue light.

In an exemplary embodiment, the third light source may include a first light emitting diode for emitting the first color light and a second light emitting diode for emitting the second color light.

In an exemplary embodiment, the display panel may display an image corresponding to one screen by a frame unit. The frame unit may include sequentially-divided first to third sub frames. The first light source may be turned on during the first sub frame, the second light source may be turned on during the second sub frame, and the third light source may be turned on during the third sub frame.

In an exemplary embodiment, the third sub frame may include sequentially-divided first and second sub fields, and the first light emitting diode may be turned on during the first sub field and the second light emitting diode may be turned on during the second sub field.

In an exemplary embodiment, each of the first light emitting diode and the second light emitting diode may be turned on during the third sub frame.

In an exemplary embodiment, the display panel may display an image corresponding to one screen by a frame unit, and each of the first to third light sources may be turned on during the frame unit.

Each of the first light emitting diode and the second light emitting diode may be turned on during the frame unit.

In an exemplary embodiment, the frame unit may include sequentially-divided third and fourth sub fields, and the first light emitting diode may be turned on during the third sub field and the second light emitting diode may be turned on during the fourth sub field.

In an exemplary embodiment, the light source unit may include a first light source for emitting the red light, a second light source for emitting the green light, a third light source for emitting the first color light, and a fourth light source for emitting the second color light.

In an exemplary embodiment, the display panel may include a red pixel which displays a red image, a green pixel which displays a green image, and a blue pixel which displays a blue image. The red pixel may include a red light emitting layer for emitting the red light, the green pixel may include a green light emitting layer for emitting the green light, and the blue pixel may include a blue light emitting layer for providing the blue light.

In an exemplary embodiment, the blue light emitting layer may include a first organic light emitting material for emitting the first color light and a second organic light emitting material for emitting the second color light.

In an exemplary embodiment, the blue light emitting layer may be provided as a single layer and the first organic light emitting material and the second organic light emitting material may be mixed and disposed at the blue light emitting layer.

In an exemplary embodiment, the blue light emitting layer may include a first light emitting layer and a second light emitting layer disposed on the first light emitting layer. The first organic light emitting material may be disposed at the first light emitting layer and the second organic light emitting material may be disposed at the second light emitting layer.

In an exemplary embodiment, the blue pixel may include a first sub pixel and a second sub pixel disposed adjacent to each other.

The first sub pixel and the second sub pixel may be provided with a smaller area than that of the red pixel and that of the green pixel.

In an exemplary embodiments of the invention, a display device includes: a driving unit which outputs a driving signal, and a display panel which displays an image by using sequentially provided red light, green light, first color light, and second color light in response to the driving signal, wherein a peak wavelength of the first color light is about 390 nm to about 410 nm, a peak wavelength of the second color light is about 480 nm to about 491 nm, and the first color light and the second color light are mixed and seen as a blue light.

BRIEF DESCRIPTION OF THE DRAWINGS

The accompanying drawings are included to provide a further understanding of the invention, and are incorporated in and constitute a part of this specification. The drawings illustrate exemplary embodiments of the invention and, together with the description, serve to explain principles of the invention. In the drawings.

DETAILED DESCRIPTION

Figure 1:
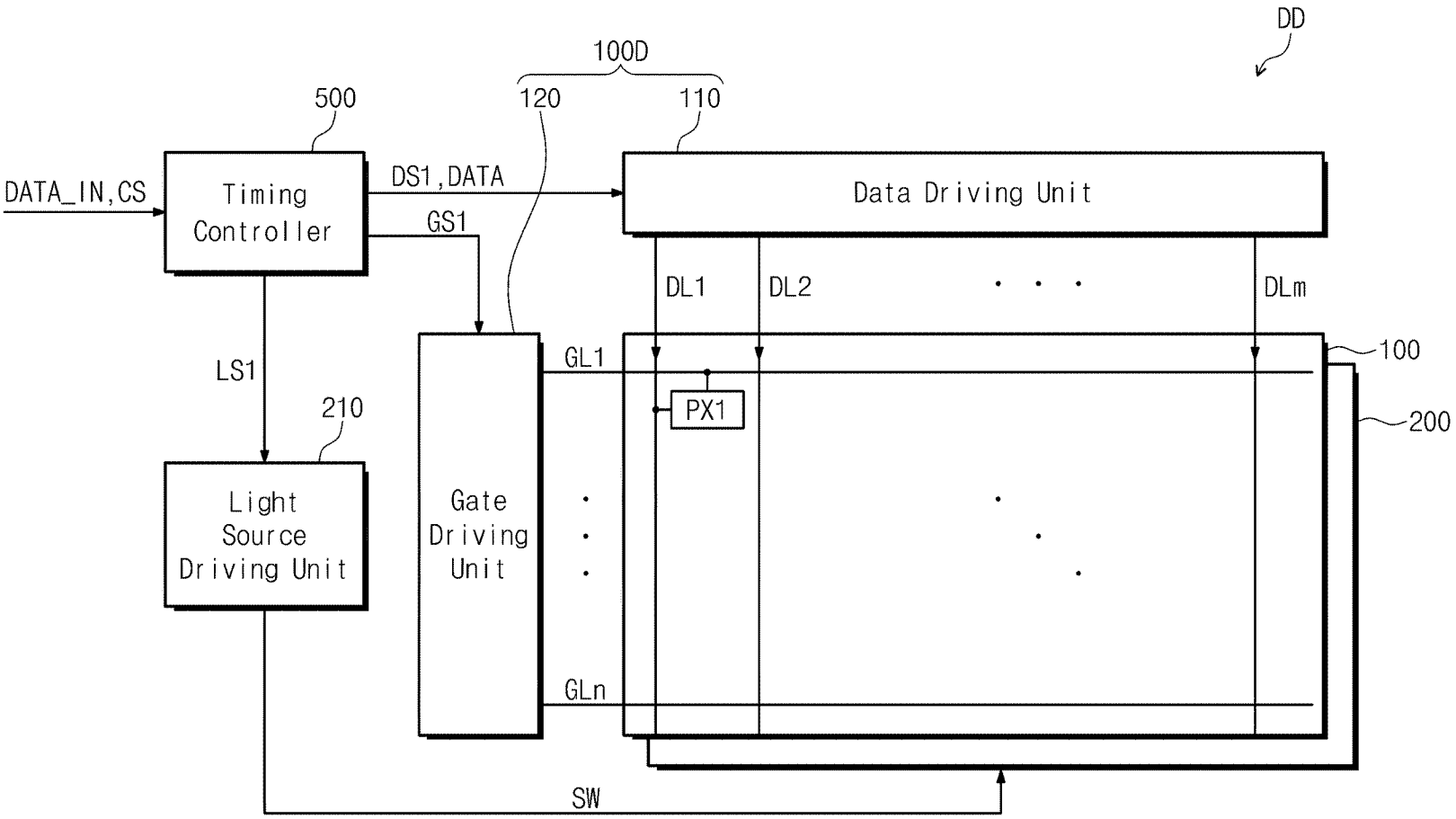
FIG. 1 is a block diagram illustrating an exemplary embodiment of a display device according to the invention.

Various modifications are possible in various embodiments of the invention and specific embodiments are illustrated in drawings and related detailed descriptions are listed. However, this does not limit various embodiments of the invention to a specific embodiment and it should be understood that the invention covers all the modifications, equivalents, and/or replacements of this disclosure provided they come within the scope of the appended claims and their equivalents.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Additionally, in various embodiments of the invention, the term "include," "comprise," "including," or "comprising," specifies a property, a region, a fixed number, a step, a process, an element and/or a component but does not exclude other properties, regions, fixed numbers, steps, processes, elements and/or components. Additionally, it will be understood that when a portion such as a layer, a film, an area, and a plate is referred to as being 'on' another portion, it may be directly on the other portion, or an intervening portion may also be present. On the other hand, it will be understood that when a portion such as a layer, a film, an area, and a plate is referred to as being 'below' another portion, it may be directly below the other portion, or an intervening portion may also be present.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. In an exemplary embodiment, when the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, when the device in one of the figures is turned over, elements described as "below" or "beneath" other elements would then be oriented "above" the other elements. The exemplary terms "below" or "beneath" can, therefore, encompass both an orientation of above and below.

Like reference numerals refer to like elements throughout the drawings. In the accompanying drawings, the dimensions of structures are enlarged than they actually are for the clarity of the invention. It will be understood that the terms "first" and "second" are used herein to describe various components but these components should not be limited by these terms. These terms are used only to distinguish one component from other components. For example, a first component may be referred to as a second component and vice versa without departing from the scope of the invention. The terms of a singular form may include plural forms unless they have a clearly different meaning in the context.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. In an exemplary embodiment, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

Hereinafter, embodiments of the invention are described in more detail with reference to the accompanying drawings.

Figure 2:
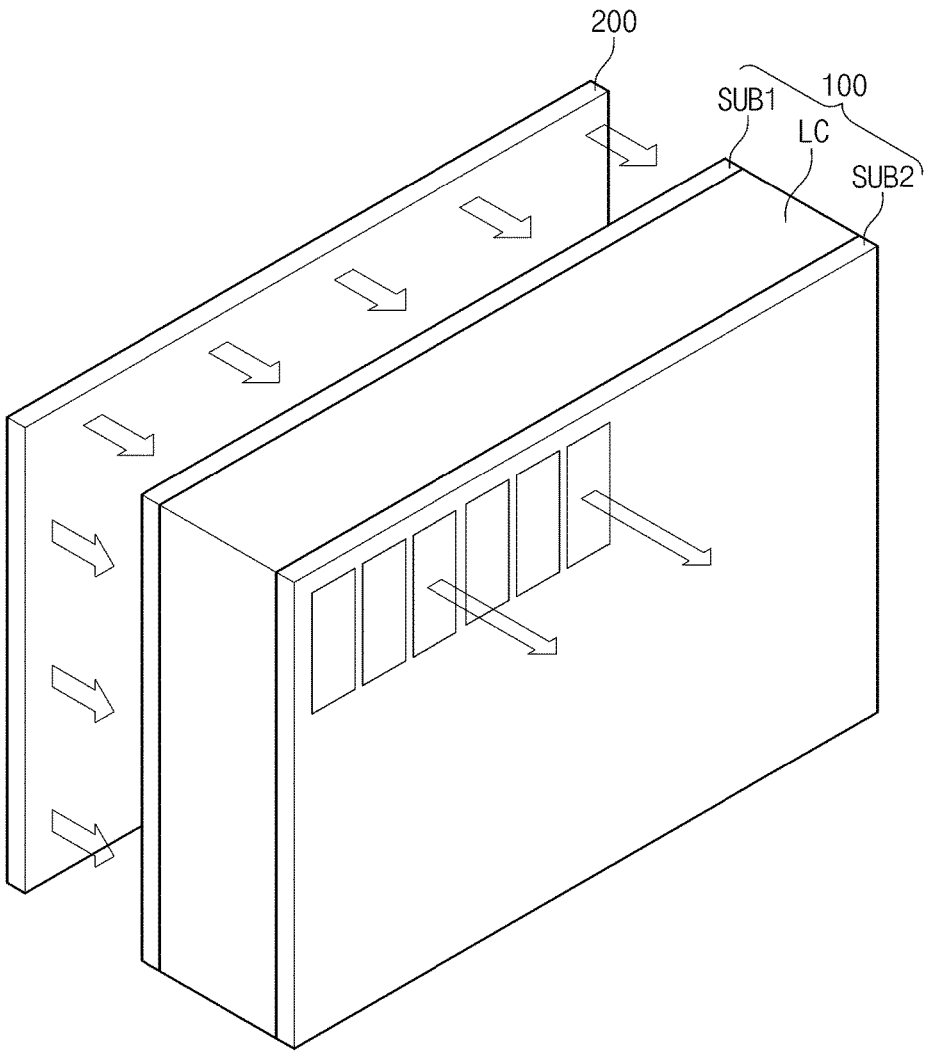
FIG. 2 is a perspective view illustrating an exemplary embodiment of a display device according to the invention.

FIG. 1 is a block diagram illustrating a display device according to an exemplary embodiment of the invention. FIG. 2 is a perspective view illustrating a display device according to an exemplary embodiment of the invention.

Referring to FIGS. 1 and 2, a display device DD may include a display panel 100, a display panel driving unit 100D, a light source unit 200, a light source driving unit 210, and a timing controller 500.

The display panel 100 generates an image corresponding to inputted image data. The display panel 100 may display an image corresponding to one screen by a frame unit. According to an exemplary embodiment of the invention, the display panel 100 may be any one of various types of displays such as a light-receiving type display panel, a liquid crystal display panel, an electrophoretic display panel, an electrowetting display panel, and a MEMS display panel. In the exemplary embodiment, a liquid crystal display panel including a liquid crystal layer LC between a first substrate SBU1 and a second substrate SUB2 is described as an example.

The display panel 100 may include a plurality of gate lines GL1 to GLn, a plurality of data lines DL1 to DLm, and a plurality of pixels PX1. The plurality of gate lines GL1 to GLn extend in a row direction and are arranged parallel to each other in a column direction. The plurality of data lines DL1 to DLm extend in a column direction and are arranged parallel to each other in a row direction. Each of the plurality of pixels PX1 may be connected to one of the gate lines GL1 to GLn and one of the data lines DL1 to DLm. One pixel PX1 connected to the first gate line GL1 and the first data line DL1 is shown as one example in FIG. 1.

The timing controller 500 receives input data DATA_IN and a control signal CS from the outside (for example, an external graphic control unit (not shown)) of the display device DD. The input data DATA_IN may include red, green, and blue data. The control signal CS may include a vertical sync signal that is a frame distinction signal, a horizontal sync signal that is a row distinction signal, and a data enable signal for displaying a zone where data enters, and a clock signal.

The timing controller 500 generates a gate control signal GS1 and a data control signal DS1 on the basis of the control signal CS. The timing controller 500 outputs the gate control signal GS1 to the gate driving unit 120 and outputs the data control signal DS1 to the data driving unit 110.

The display panel driving unit 100D may drive the display panel 100. The display panel driving unit 100D may include a data driving unit 110 and a gate driving unit 120. The gate control signal GS1 is a signal for driving the gate driving unit 120 and the data control signal DS1 is a signal for driving the data driving unit 110.

The data driving circuit 110 generates a grayscale voltage according to an output data DATA converted based on the data control signal DS1 and outputs the grayscale to the data lines DL1 to DLm. The data control signal DS1 may include a horizontal start signal for notifying that the converted output data DATA starts to be transmitted to the data driving unit 110, a load signal for applying grayscale signal to the data lines DL1 to DLm, and an invert signal for inverting the polarity of a data voltage with respect to a common voltage.

The gate driving unit 120 generates a gate signal on the basis of the gate control signal GS1 and outputs a gate signal to the gate lines GL1 to GLn. The gate control signal GS1 may include a scan start signal for indicating scan start, at least one clock signal for controlling an output period of a gate on voltage, and an output enable signal for limiting a duration time of a gate on voltage. The gate driving unit 120 sequentially outputs gate signals. Accordingly, the plurality of pixels PX1 may be sequentially scanned by a row unit in response to a gate signal.

The light source unit 200 is disposed under the display panel 100 and supplies light to the display panel 100. The light source unit 200 may employ a plurality of light emitting diodes (not shown) as a light source. In this case, a plurality of light emitting diodes may be mounted on a printed circuit board and disposed facing a back surface of the display panel 100. The light source unit 200 may be further include a light guide plate (not shown) disposed at the back surface of the display panel 100 for guiding light provided from the plurality of light emitting diodes to the display panel 100. The plurality of light emitting diodes (not shown) may be disposed on one side of the light guide plate. According to an exemplary embodiment of the invention, a direct-type structure where the plurality of light emitting diodes face the back surface of the display panel 100 is shown as an example and described.

Figure 3:
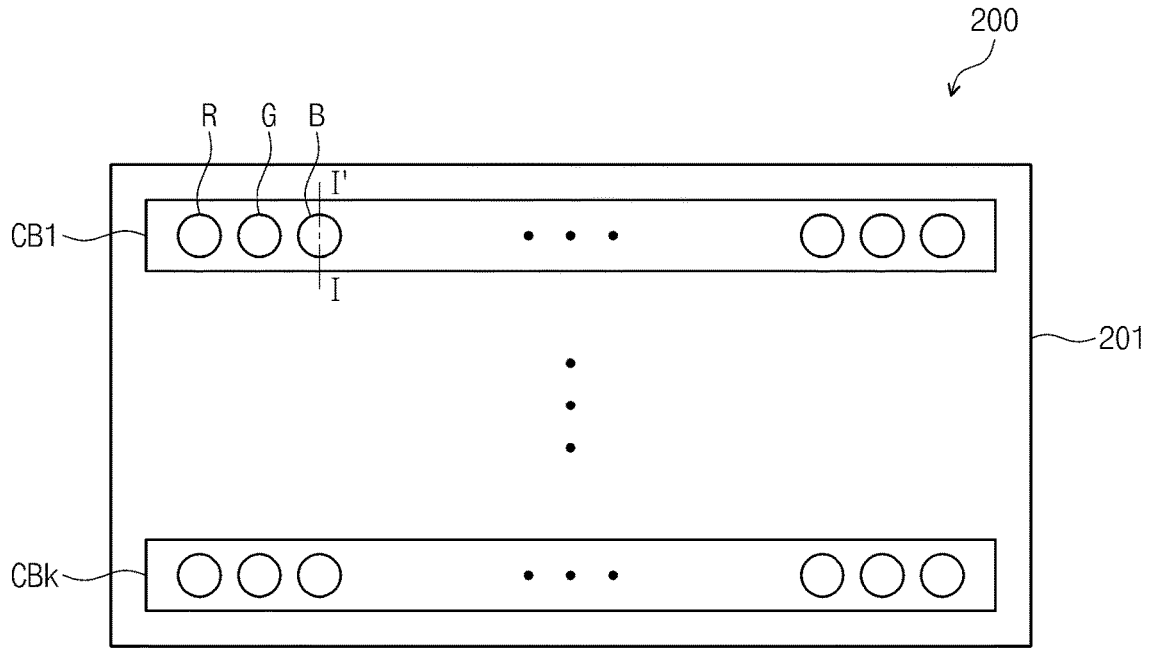
FIG. 3 is a plan view illustrating an exemplary embodiment of a light source unit according to the invention.
Figure 4:
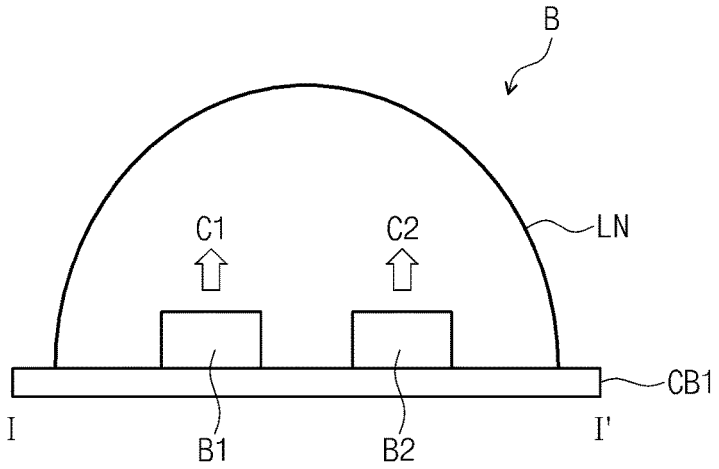
FIG. 4 is a sectional view taken along line I-I' of FIG. 3.

FIG. 3 is a plan view illustrating a light source unit according to an exemplary embodiment of the invention. FIG. 4 is a sectional view taken along line I-I' of FIG. 3. Hereinafter, a light source unit 200 will be described in more detail with reference to the drawings.

Referring to FIG. 3, the light source unit 200 may include a bottom chassis 201, first to kth circuit bars CB1 to CBk (k is a positive integer) arranged on the bottom chassis 201 in one direction, and a first light source R, a second light source G, and a third light source B mounted on the first to kth circuit bars CB1 to CBk. The first light source R is a light source for emitting red light, the second light source G is a light source for emitting green light, and the third light source B is a light source for providing blue light. In the exemplary embodiment, although it is shown that the first to third light sources R, G, and B are arranged sequentially in one direction, an exemplary embodiment of the invention is not limited thereto and the arrangement order and the arrangement direction may vary.

The first light source R, the second light source G, and the third light source B may provide light having the same intensity to the display panel 100 and may provide the brightness of a displayed image through the transmittance adjustment of each of the pixels PX1 of FIG. 1 in the display panel 100. However, an exemplary embodiment of the invention is not limited thereto and according to another embodiment of the invention, the brightness of a displayed image may be adjusted by adjusting the intensity of light from the first light source R, the second light source G, and the third light source B.

Referring to FIG. 4, according to an exemplary embodiment of the invention, each third light source B may include a first light emitting diode B1 and a second light emitting diode B2. The first light emitting diode B1 and the second light emitting diode B2 may be covered by one lens LN.

In an exemplary embodiment, the first light emitting diode B1 emits a first color light C1 having a peak wavelength of about 390 nanometers (nm) to about 410 nm, for example. In an exemplary embodiment, the half width of the first color light C1 may be about 17 nm to about 25 nm, for example. Herein, the color of the first color light C1 may be purple, for example.

In an exemplary embodiment, the second light emitting diode B2 emits a second color light C2 having a peak wavelength of about 480 nm to about 491 nm, for example. In an exemplary embodiment, the half width of the second color light C2 may be about 17 nm to about 23 nm, for example. Herein, the color of the second color light C2 may be cyan, for example.

The first color light C1 and the second color light C2 respectively emitted from the first light emitting diode B1 and the second light emitting diode B2 are mixed and seen as a blue light.

Figure 5:
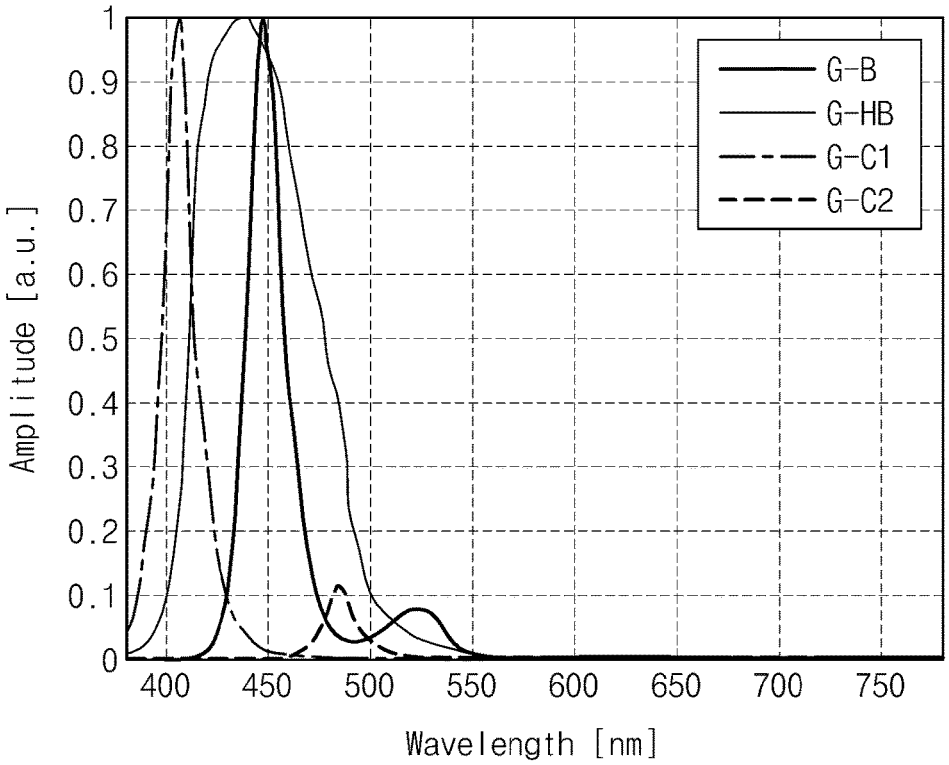
FIG. 5 is a graph illustrating a wavelength band of each of blue light, first color light, and second color light.
Figure 6:
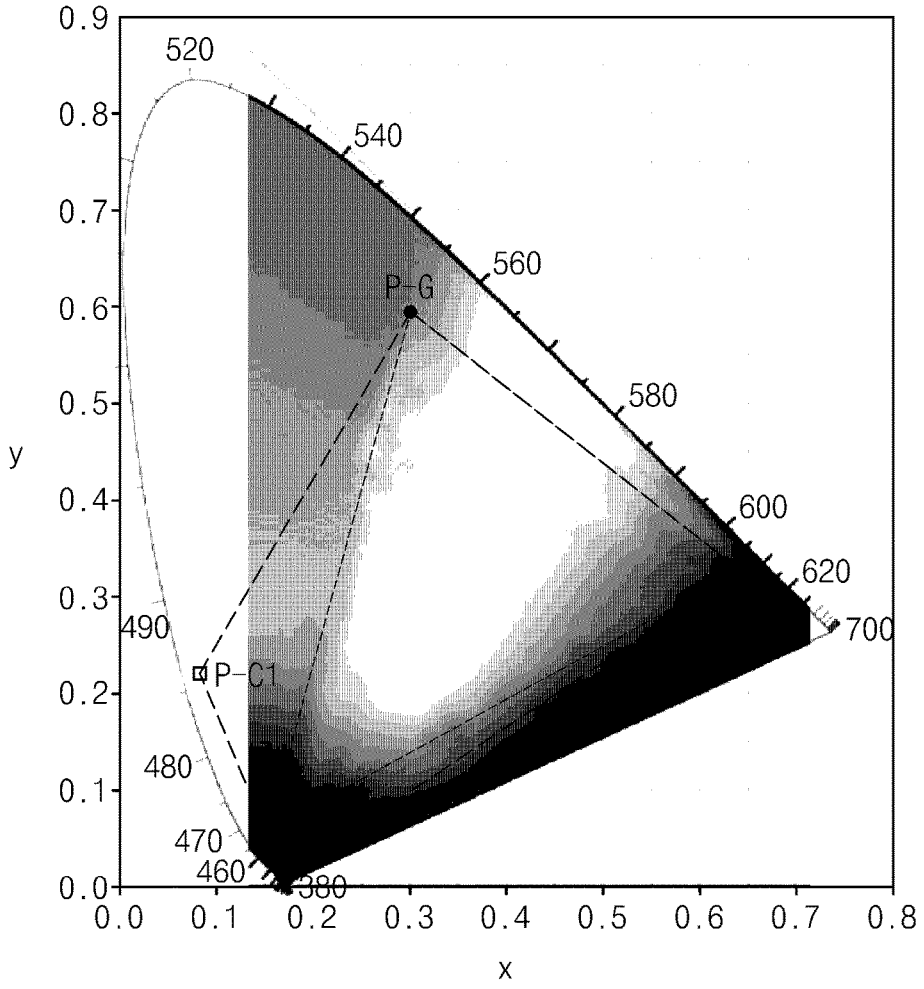
FIG. 6 is a color coordinate diagram illustrating an exemplary embodiment of a color gamut according to the invention.

FIG. 5 is a graph illustrating a wavelength band of each of blue light, first color light, and second color light. FIG. 6 is a color coordinate diagram illustrating a color gamut according to an exemplary embodiment of the invention.

FIG. 5 shows a harmful blue light graph G-HB representing a wavelength band of harmful blue light representing a wavelength band of blue light, a blue light graph G-B, a first color light graph G-C1 representing a wavelength band of first color light, and a second color light graph G-C2 representing a wavelength band of second color light.

The harmful blue light having a wavelength band of about 415 nm to about 455 nm shown in FIG. 5 may facilitate the generation of Reactive Oxygen Species ("ROS") to generate Lipofuscin. As a result, as Retinal Pigment Epithelium is damaged, eyesight may be deteriorated.

As shown in FIG. 5, a wavelength band of blue light having a peak wavelength of about 450 nm may be included in a wavelength band of harmful blue light. In case that the blue light having a peak wavelength of about 450 nm is directly provided to a display panel, this may deteriorate the sight of a viewer.

According to an exemplary embodiment of the invention, it is possible to display a blue image by using the first color light C1 and the second color light C2 having a wavelength band having at least a portion off from a wavelength band of harmful blue light. As shown in FIG. 5, an area where blue light overlaps a wavelength band of harmful blue light with respect to an area where the first color light C1 and the second color light C2 overlap a wavelength band of harmful blue light may be reduced to about 57%. As a result, a risk level that causes eyesight deterioration by blue light of about 450 nm may be reduced to about 57%.

FIG. 6 illustrates color coordinates displaying a color coordinate P-R of red light provided from the first light source R, a color coordinate P-G of green light provided from the second light source G, a color coordinate P-C1 of first color light provided from the first light emitting diode B1, and a color coordinate P-C2 of second color light provided from the second light emitting diode B2.

As shown in FIG. 6, the color coordinate P-C1 of the first color light and the color coordinate P-C2 of the second color light may be disposed on a straight line passing through a point of about (0.15,0.06)±0.003 that is the color coordinate P-B of blue light. According to an exemplary embodiment of the invention, as using red light, green light, the first color light C1, and the second color light C2, it is possible to expand a displayable color gamut in comparison to a range of colors displayable using typical red light, green light, and blue light.

In Table 1, the first color light C1 and the second color light C2 are mixed to calculate a wavelength band of the first color light C1 and a wavelength band of the second color light C2 that satisfy about (0.15,0.06)±0.003 that is the color coordinate P-B of blue light. A calculation value is a relative amplitude value of a measured second color light C2 when an amplitude in a specific wavelength band is normalized to 1. Herein, each of the half width of the first color light C1 and the half width of the second color light C2 is based on about 17 nm.

TABLE 1

| | | C1 [nm] | | | | | | | | | | |
|---|---|---|---|---|---|---|---|---|---|---|---|---|
| | | 390 | 391 | 392 | 393 | 394 | 395 | 396 | 397 | 398 | 399 | 400 |
| C2 [nm] | 480 | 0.036 | 0.04 | 0.044 | 0.048 | 0.052 | 0.06 | 0.064 | 0.072 | 0.076 | 0.084 | 0.092 |
| | 481 | 0.032 | 0.036 | 0.04 | 0.044 | 0.048 | 0.056 | 0.06 | 0.064 | 0.072 | 0.08 | 0.088 |
| | 482 | 0.032 | 0.036 | 0.036 | 0.04 | 0.048 | 0.052 | 0.056 | 0.06 | 0.068 | 0.072 | 0.08 |
| | 483 | 0.028 | 0.032 | 0.036 | 0.04 | 0.044 | 0.048 | 0.052 | 0.056 | 0.064 | 0.068 | 0.076 |
| | 484 | 0.028 | 0.032 | 0.032 | 0.036 | 0.04 | 0.044 | 0.048 | 0.056 | 0.06 | 0.064 | 0.072 |
| | 485 | X | 0.028 | 0.032 | 0.036 | 0.04 | 0.044 | 0.048 | 0.052 | 0.056 | 0.06 | 0.068 |
| | 486 | X | 0.028 | X | X | 0.036 | 0.04 | 0.044 | 0.048 | 0.052 | 0.056 | 0.064 |
| | 487 | X | X | X | 0.032 | X | X | X | 0.044 | 0.048 | 0.056 | 0.06 |
| | 488 | X | X | X | X | X | X | 0.04 | 0.044 | 0.048 | 0.052 | 0.056 |
| | 489 | X | X | X | X | X | X | X | X | X | X | X |
| | 490 | X | X | X | X | X | X | X | X | X | X | X |
| | 491 | X | X | X | X | X | X | X | X | X | X | X |

| | | C1 [nm] | | | | | | | | | |
|---|---|---|---|---|---|---|---|---|---|---|---|
| | | 401 | 402 | 403 | 404 | 405 | 406 | 407 | 408 | 409 | 410 |
| C2 [nm] | 480 | 0.1 | 0.112 | 0.12 | X | X | X | X | X | X | X |
| | 481 | 0.096 | 0.104 | 0.112 | 0.124 | 0.132 | 0.144 | 0.156 | 0.168 | 0.184 | X |
| | 482 | 0.088 | 0.096 | 0.104 | 0.116 | 0.124 | 0.136 | 0.148 | 0.16 | 0.172 | 0.188 |
| | 483 | 0.084 | 0.092 | 0.1 | 0.108 | 0.116 | 0.128 | 0.136 | 0.148 | 0.16 | 0.176 |
| | 484 | 0.076 | 0.084 | 0.092 | 0.1 | 0.106 | 0.12 | 0.128 | 0.14 | 0.152 | 0.164 |
| | 485 | 0.072 | 0.08 | 0.088 | 0.096 | 0.104 | 0.112 | 0.12 | 0.132 | 0.144 | 0.156 |
| | 486 | 0.068 | 0.076 | 0.084 | 0.088 | 0.098 | 0.104 | 0.116 | 0.124 | 0.136 | 0.148 |
| | 487 | 0.064 | 0.072 | 0.076 | 0.084 | 0.092 | 0.1 | 0.108 | 0.118 | 0.126 | 0.14 |
| | 488 | 0.06 | 0.088 | 0.072 | 0.08 | 0.088 | 0.096 | 0.104 | 0.112 | 0.12 | 0.132 |
| | 489 | 0.06 | 0.064 | X | 0.076 | 0.084 | 0.088 | 0.096 | 0.104 | 0.116 | 0.124 |
| | 490 | X | X | 0.069 | X | 0.08 | X | 0.092 | 0.1 | 0.106 | 0.116 |
| | 491 | X | X | X | X | X | X | X | X | X | 0.112 |

As shown in Table 1, when a peak wavelength of the first color light is about 390 nm to about 410 nm and a peak wavelength of the second color light C2 is about 480 nm to about 491 nm, it is possible that the first color light C1 and the second color light C2 are not included in a peak wavelength band of harmful blue light and display a blue image.

In Table 2, the first color light C1 and the second color light C2 are mixed to calculate the maximum half width of the first color light C1 and the maximum half width of the second color light C2 that satisfy about (0.15,0.06)±0.003 that is the color coordinate P-B of existing blue light. In a case that an amplitude is normalized to 1 when a peak wavelength of the first color light C1 is about 406 nm, a calculation value is a relative amplitude value when a peak wavelength of the second color light C2 is about 485 nm.

TABLE 2

| | | C1 (FWHM) | | | | | | | | |
|---|---|---|---|---|---|---|---|---|---|---|
| | | 17 | 18 | 19 | 20 | 21 | 22 | 23 | 24 | 25 |
| C2 (FWHM) | 17 | 0.112 | 0.124 | 0.152 | 0.16 | 0.168 | 0.18 | 0.188 | 0.204 | 0.204 |
| | 18 | 0.104 | 0.116 | 0.14 | 0.148 | 0.16 | 0.168 | 0.176 | 0.192 | 0.192 |
| | 19 | 0.088 | 0.096 | 0.12 | 0.124 | 0.132 | 0.14 | 0.148 | 0.164 | 0.164 |
| | 20 | 0.084 | 0.092 | 0.112 | 0.12 | 0.128 | 0.132 | 0.14 | 0.152 | 0.152 |
| | 21 | 0.08 | 0.088 | 0.104 | 0.112 | 0.12 | 0.124 | 0.132 | 0.144 | 0.144 |
| | 22 | 0.076 | X | 0.1 | 0.108 | 0.112 | 0.12 | 0.124 | 0.136 | 0.136 |
| | 23 | X | X | X | X | X | X | 0.12 | 0.132 | 0.132 |

As shown in Table 2, when a half width wavelength of the first color light is about 17 nm to about 25 nm and a half width of the second color light C2 is about 17 nm to about 23 nm, it is possible that the first color light C1 and the second color light C2 are not included in a peak wavelength band of harmful blue light and display a blue image.

Figure 7:
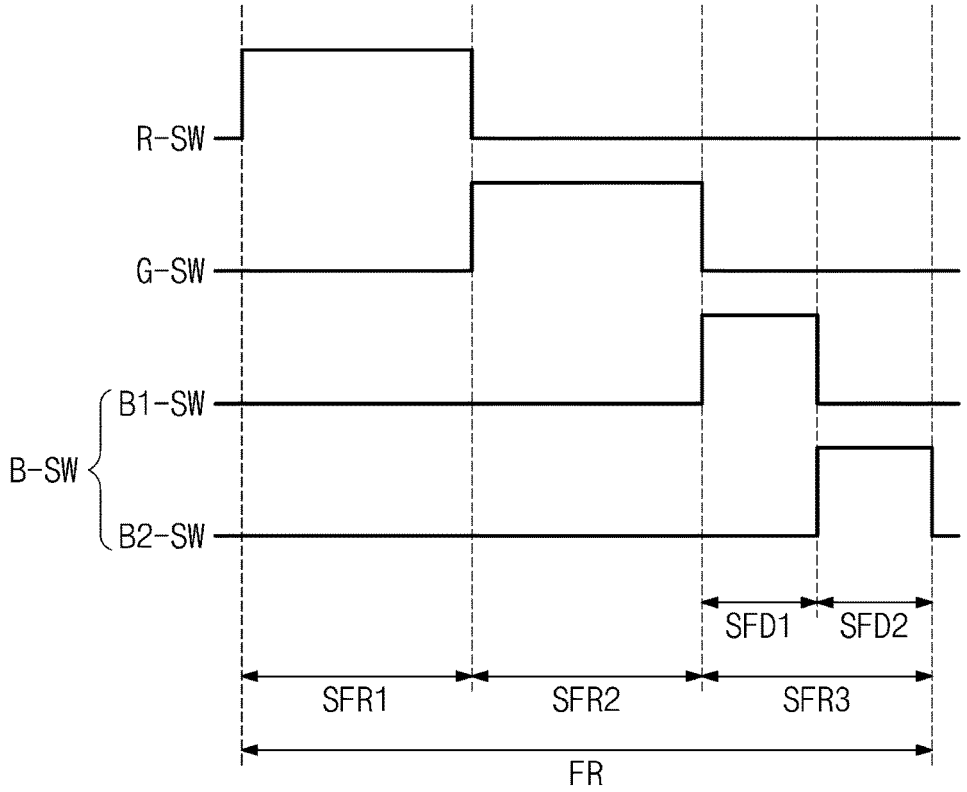
FIG. 7 is a signal diagram of an exemplary embodiment of switching signals according to the invention.

FIG. 7 is a signal diagram illustrating switching signals according to an exemplary embodiment of the invention and illustrates one unit frame section FR among a plurality of frame sections. Hereinafter, referring to FIG. 7, a method of driving the first light source R, the second light source G, and the third light source B is described.

According to an exemplary embodiment of the invention, the first light source R, the second light source G, and the third light source B may be sequentially turned on in the unit frame section FR.

The unit frame section FR may include sequentially-divided first to third sub frame sections SFR1 to SFR3. Each of the first light source R, the second light source G, and the third light source B may be selectively turned on or turned off in some sub frame sections among the first to third sub frame sections SFR1 to SFR3.

Each of the first light source R, the second light source G, and the third light source B may be turned on or turned off in response to switching signals SW outputted from the light source driving unit 210 of FIG. 1.

The switching signals SW may include a first switching signal R-SW applied to the first light source R, a second switching signal G-SW applied to the second light source G, and a third switching signal B-SW applied to the third light source B.

Each of the first to third switching signals R-SW, G-SW, and B-SW may be divided into at least one high section having a high level and at least one low section having a low level.

The first switching signal R-SW may have a high level in the first sub frame section SFR1 and a low level in the second and third sub frame sections SRF2 and SFR3. The first switching signal R-SW may be applied to the first light source R and turn on the first light source R during the first sub frame section SFR1.

The second switching signal G-SW may have a high level in the second sub frame section SFR2 and a low level in the first and third sub frame sections SRF1 and SFR3. The second switching signal G-SW may be applied to the second light source G and turn on the second light source G during the second sub frame section SFR2.

The third switching signal B-SW may have a high level in the third sub frame section SFR3 and a low level in the first and second sub frame sections SRF1 and SFR2. The third switching signal B-SW may be applied to the third light source B and turn on the third light source B during the third sub frame section SFR3.

According to an exemplary embodiment of the invention, as the first switching signal R-SW is applied to the first light source R during the first sub frame section SFR1, red light may be provided to the display panel 100. Then, as the second switching signal G-SW is applied to the second light source G during the second sub frame section SFR2, green light may be provided to the display panel 100. Then, as the third switching signal B-SW is applied to the third light source B during the third sub frame section SFR3, blue light may be seen from the display panel 100.

The third sub frame section SFR3 may include sequentially-divided first sub field SFD1 and second sub field SFD2. In the third sub frame section SFR3, the third switching signal B-SW may be divided into a first light emitting switching signal B1-SW and a second light emitting switching signal B2-SW.

During the first sub field SFD1, as the first light emitting switching signal B1-SW is applied to the first light emitting diode B1, first color light C1 may be provided to the display panel 100. Then, during the second sub field SFD2, as the second light emitting switching signal B2-SW is applied to the second light emitting diode B2, second color light C2 may be provided to the display panel 100.

In the third sub frame section SFR3 where the first color light C1 and the second color light C2 are provided sequentially, due to the afterimage effect of eyes, blue light where the first and second color lights C1 and C2 are mixed may be seen.

According to an exemplary embodiment of the invention, although it is shown and described that each of the first light source R, the second light source G, and the third light source B is turned on for a predetermined time, an exemplary embodiment of the invention is not limited thereto and a turn-on time of each of the first light source R, the second light source G, and the third light source B may vary.

However, according to another embodiment of the invention, the first light source R, the second light source G, and the third light source B may be driven through methods different from that of the embodiment of the invention. Hereinafter, another embodiment of the invention will be described with reference to the drawings. For convenience of description, description focuses on the differences from the embodiment of the invention and omitted parts follow the embodiment of the invention. Additionally, like reference numerals refer to like components throughout and overlapping descriptions of the components will be omitted.

Figure 8:
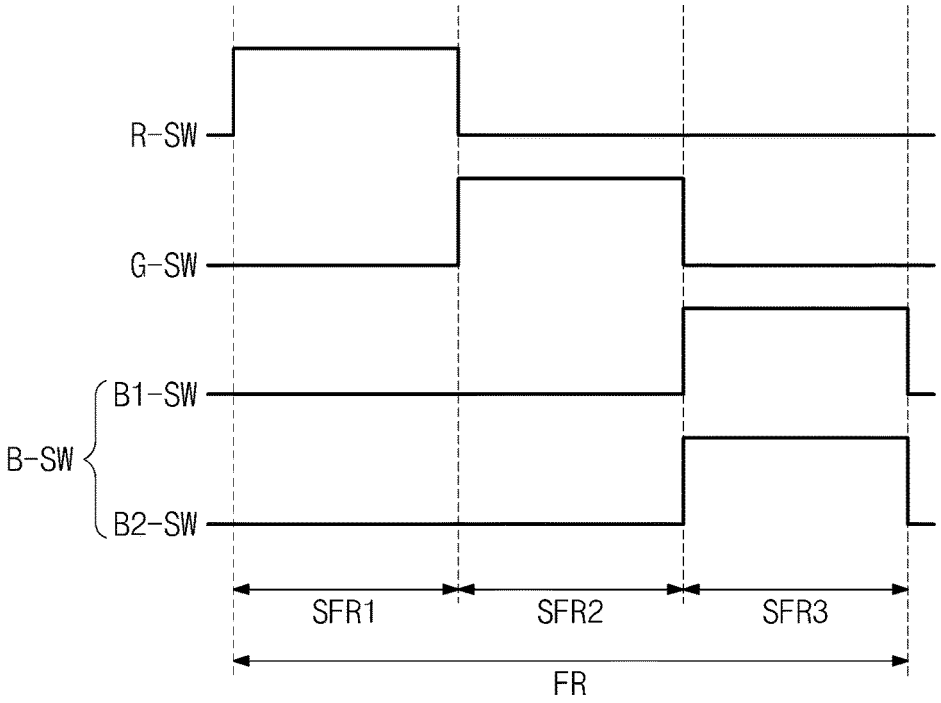
FIG. 8 is a signal diagram of another embodiment of switching signals according to the invention.

FIG. 8 is a signal diagram illustrating switching signals according to another embodiment of the invention and illustrates one unit frame section FR among a plurality of frame sections.

According to another exemplary embodiment of the invention, the first light source R, the second light source G, and the third light source B may be sequentially turned on in the unit frame section FR. Like the embodiment of the invention, the first light source R may provide red light to the display panel 100 during the first sub frame section SFR1 and the second light source G may provide green light to the display panel 100 during the second sub frame section SFR2. According to another exemplary embodiment of the invention, since there is a difference in a method of driving the third light source B, this will be described mainly.

According to another exemplary embodiment of the invention, each of the first light emitting diode B1 and the second light emitting diode B2 may be turned on during the third sub frame section SFR3.

During the third sub frame section SFR3, as the first light emitting switching signal B1-SW is applied to the first light emitting diode B1, first color light C1 may be provided to the display panel 100. During the sub frame section SFR3, as the second light emitting switching signal B2-SW is applied to the second light emitting diode B2, second color light C2 may be provided to the display panel 100. The first color light C1 and the second color light C2 provided during the sub frame section SFR3 may be mixed and seen as a blue light.

As mentioned above, although it is described that the first to third light sources R, G, and B are turned on sequentially, an exemplary embodiment of the invention is not limited thereto and each of the first to third light sources R, G, and B may be turned on during the unit frame section FR.

Figure 9:
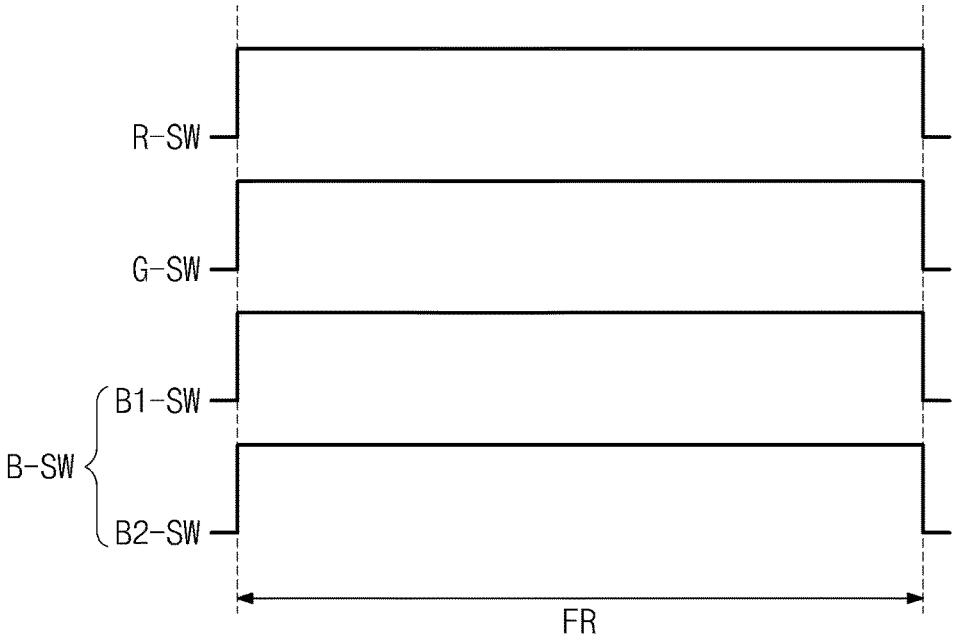
FIG. 9 is a signal diagram of another embodiment of switching signals according to the invention.

FIG. 9 is a signal diagram illustrating switching signals according to another embodiment of the invention and illustrates one unit frame section FR among a plurality of frame sections.

According to another exemplary embodiment of the invention, each of the first light source R, the second light source G, the first light emitting diode B1, and the second light emitting diode B2 may be turned on during the unit frame section FR.

As the first switching signal R-SW is applied to the first light source R during the unit frame section FR, red light may be provided to the display panel 100.

As the second switching signal G-SW is applied to the second light source G during the unit frame section FR, green light may be provided to the display panel 100.

As the third switching signal B-SW is applied to each of the first light emitting diode B1 and the second light emitting diode B2 during the unit frame section FR, the display panel 100 may provide first color light C1 and second color light C2. The first color light C1 and the second color light C2 may be mixed and seen as a blue light.

The red light, the green light, the first color light C1, and the second color light C2 provided during the unit frame section FR are mixed and provided as white light.

When white light is provided during the unit frame section FR, a first substrate SUB1 or a second substrate SUB2 of the display panel 100 may further include a color filter (not shown). As one example, when color filters of red, green, and blue are provided, white light passing through the color filters may be respectively displayed as red color, green color, and blue color.

Figure 10:
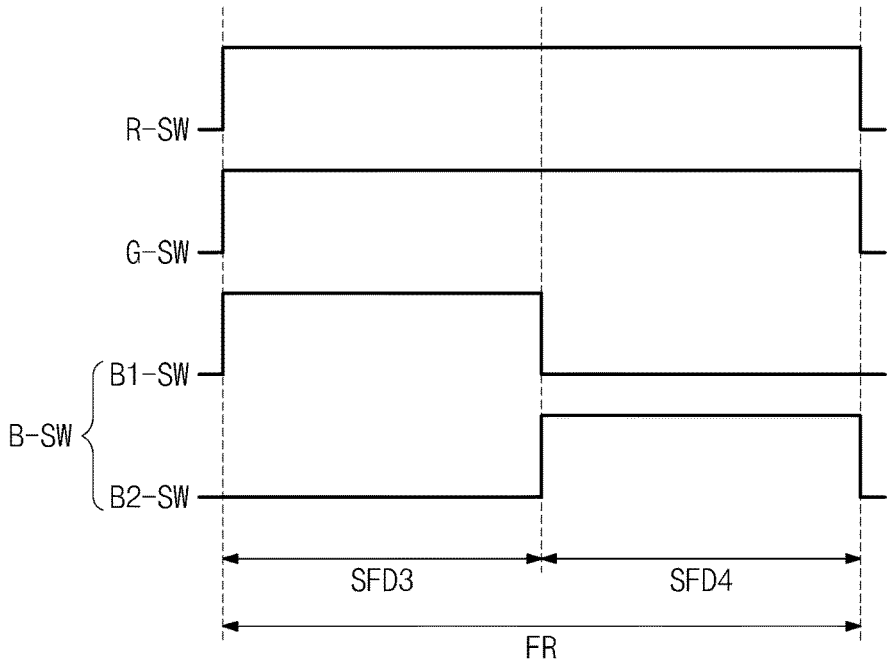
FIG. 10 is a signal diagram of another embodiment of switching signals according to the invention.

FIG. 10 is a signal diagram illustrating switching signals according to another embodiment of the invention and illustrates one unit frame section FR among a plurality of frame sections.

According to another exemplary embodiment of the invention, the first light source R and the second light source G may be turned on and the first light emitting diode B1 and the second light emitting diode B2 may be sequentially turned on, during the unit frame section FR.

The unit frame section FR may include sequentially-divided third field SFD3 and fourth field SFD4.

During the third field SFD3, as the first light emitting switching signal B1-SW is applied to the first light emitting diode B1, first color light C1 may be provided to a display panel 100. Then, during the fourth field SFD4, as the second light emitting switching signal B2-SW is applied to the second light emitting diode B2, second color light C2 may be provided to the display panel 100. The first color light C1 and the second color light C2 sequentially provided during the unit frame section FR may be seen as a blue light.

Figure 11:
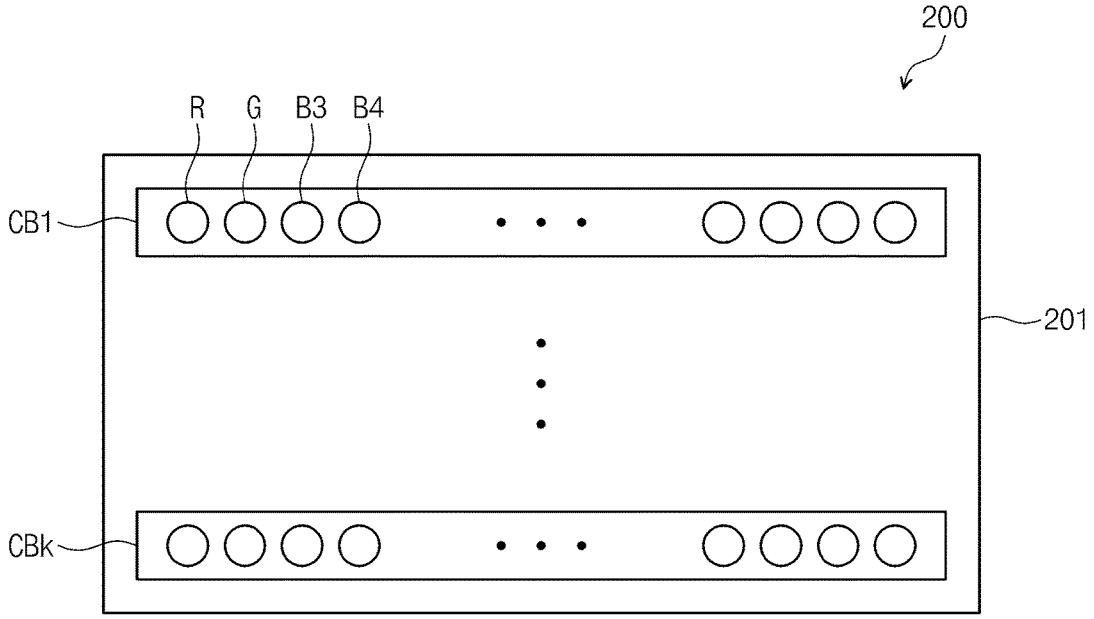
FIG. 11 is a plan view illustrating another embodiment of a light source unit according to the invention.

FIG. 11 is a plan view illustrating a light source unit according to another embodiment of the invention.

For convenience of description, description focuses on the differences from the above described exemplary embodiments of the invention and omitted parts follow the embodiment of the invention. Additionally, like reference numerals refer to like components throughout and overlapping descriptions of the components will be omitted.

Referring to FIG. 11, a light source unit 200 may include a bottom chassis 201, first to kth circuit bars CB1 to CBk (k is a positive integer) arranged on the bottom chassis 201 in one direction, and a first light source R, a second light source G, a third light source B3, and a fourth light source B4 mounted on the first to kth circuit bars CB1 to CBk. The first light source R is a light source for emitting red light and the second light source G is a light source for emitting green light. The third light source B3 is a light source for emitting first color light and the fourth light source B4 is a light source for emitting second color light. The first color light and the second color light may be mixed and seen as a blue light.

Although it is shown in FIG. 11 that the first to fourth light sources R, G, B3, and B4 are arranged sequentially in one direction, an exemplary embodiment of the invention is not limited thereto and the arrangement order and the arrangement direction may vary.

The first to fourth light sources R, G, B3, and B4 may be sequentially turned on during a unit frame section or each of the first to fourth light sources R, G, B3, and B4 may be turned on during a unit frame section.

Although a display device including a liquid crystal display panel applied is described as an example according to an exemplary embodiment of the invention, a display to which an organic light emitting display panel that is a light emitting type display panel is applied will be described according to another embodiment of the invention.

Figure 12:
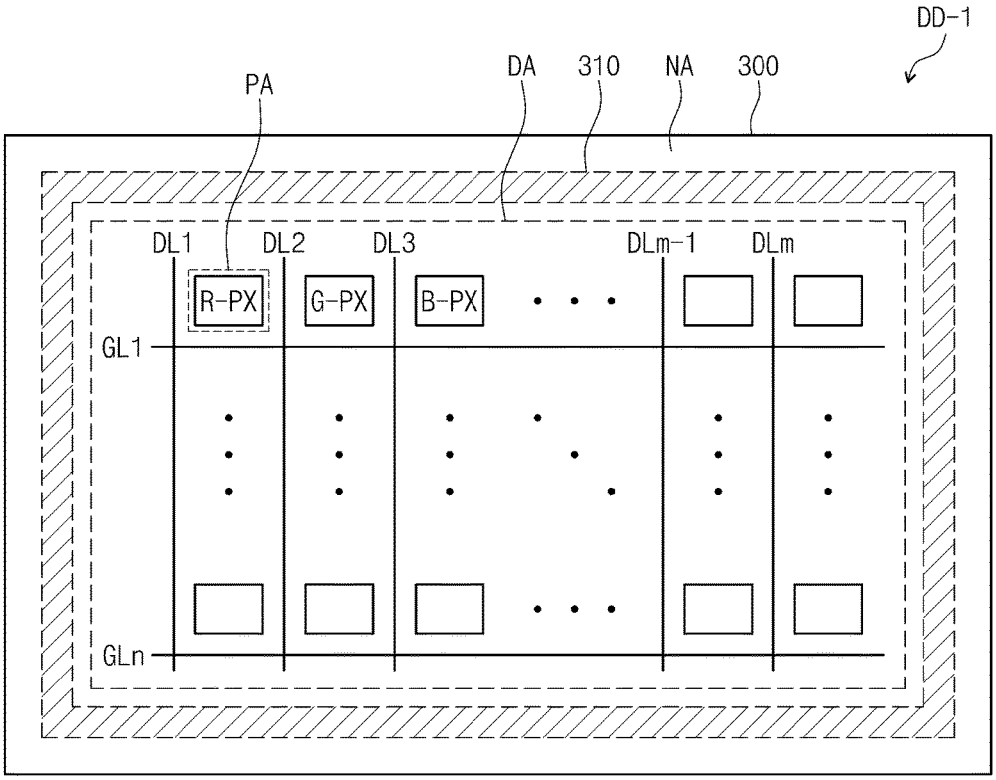
FIG. 12 is a plan view illustrating another embodiment of a display device according to the invention.
Figure 13:
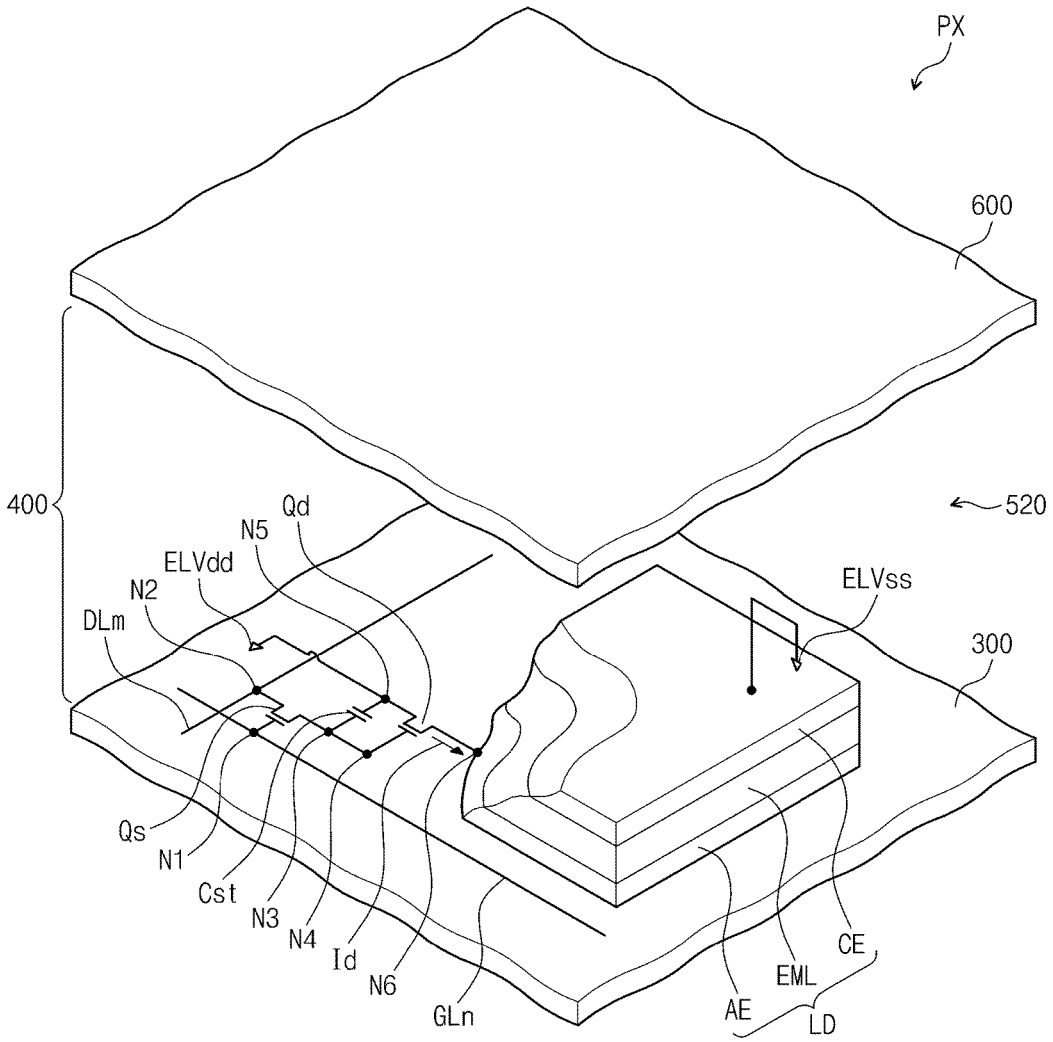
FIG. 13 is a conceptual diagram of one pixel.

FIG. 12 is a plan view illustrating a display device according to another embodiment of the invention and FIG. 13 is a conceptual diagram illustrating one pixel.

Referring to FIGS. 12 and 13, a display device DD-1 may include a substrate 300, a pixel layer 400, and a sealing layer 600.

The substrate 300 includes a display area DA for displaying an image and a non display area NA adjacent to the display area DA and displaying no image. The display area DA may include a plurality of pixel areas PA.

The pixel layer 400 may be disposed between the substrate 300 and the sealing layer 600.

The pixel layer 400 may include a plurality of gate lines GL1 to GLn, a plurality of data lines DL1 to DLm, and a plurality of pixels. The plurality of pixels may include a red pixel R-PX for displaying a red image, a green pixel G-PX for displaying a green image, and a blue pixel B-PX for displaying a blue image.

The gate lines GL1 to GLn and the data lines DL1 to DLm may be insulated from each other and intersect each other. The gate lines GL1 to GLn and the data lines DL1 to DLm may define pixel areas PA.

Each of the pixels R-PX, G-PX, and B-PX (hereinafter referred to as PX) may be provided in each pixel area PA. Each of the pixels PX may be connected to one of the gate lines GL1 to GLn and one of the data lines DL1 to DLm and display an image. In an exemplary embodiment, each of the pixels PX may display one of red, green, and blue colors, for example. However, an exemplary embodiment of the invention is not limited thereto and each of the pixels PX may display another color other than red, green, and blue colors. Although it is shown in FIG. 1 that each pixel PX has a rectangular shape, for example, an exemplary embodiment of the invention is not limited thereto and each pixel PX may have various other shapes such as a circular shape and an oval shape.

Each pixel PX may include a driving device layer 410 (refer to FIG. 14) and an organic light emitting device layer 430 (refer to FIG. 14) disposed on the driving device layer 410.

The driving device layer 410 may include a switching transistor Qs, a driving transistor Qd, and a storage capacitor Cst.

The switching transistor Qs may include a control terminal N1, an input terminal N2, and an output terminal N3. The control terminal N1 is connected to one gate line GLn, the input terminal N2 is connected to one data line DLm, and the output terminal N3 is connected to the driving transistor Qd. The switching transistor Qs outputs a data voltage applied to one data line DLm to the driving transistor Qd in response to a gate signal applied to the one gate line GLn.

The driving transistor Qd may include a control terminal N4, an input terminal N5, and an output terminal N6. The control terminal N4 is connected to the output terminal N3 of the switching transistor Qs, the input terminal N5 receives a driving voltage ELVdd, and the output terminal N6 is connected to an organic light emitting device LD. The driving transistor Qd outputs, to the organic light emitting device LD, an output current Id having a size varying according to a voltage applied between the control terminal N4 and the output terminal N6.

The storage capacitor Cst may be connected between the output terminal N3 of the switching transistor Qs and the input terminal N5 of the driving transistor Qd. The storage capacitor Cst charges a data voltage applied to the control terminal N4 of the driving transistor Qd and after the switching transistor Qs is turned off, maintains the charged data voltage for a predetermined time.

The driving device layer 410 may further include a driving voltage line (not shown). The driving voltage line may extend parallel to one gate line GLn or one data line DLm. The driving voltage line may receive a driving voltage ELVdd and may be connected to the input terminal N5 of the driving transistor Qd.

The organic light emitting device layer 430 may include an organic light emitting device LD disposed on the driving device layer 410. The organic light emitting device LD may include a first electrode AE, a second electrode CE, and a light emitting layer EML.

In an exemplary embodiment, the first electrode AE may be an anode electrode or a positive electrode. The first electrode AE is connected to the output terminal N6 of the driving transistor Qd and generates holes. In an exemplary embodiment, the second electrode CE may be a cathode electrode or a negative electrode. The second electrode CE receives a common voltage ELVss and generates electrons.

Holes and electrons are injected from the first electrode AE and the second electrode CE into the light emitting layer EML. An exiton where holes and electrons are combined is provided inside the light emitting layer EML and emits light as dropping from an excited state into a ground state. The intensity of light emitted from the light emitting layer EML may be determined by an output current Id flowing in the output terminal N6 of the driving transistor Qd.

According to an exemplary embodiment of the invention, although it is shown that the second electrode CE is disposed on the first electrode AE, an exemplary embodiment of the invention is not limited thereto and the positions of the first electrode AE and the second electrode CE may be interchangeable.

The light emitting layer EML may be disposed between the first electrode AE and the second electrode CE. The light emitting layer EML may include a low molecular organic material or a polymer organic material.

A red pixel R-PX may include a red light emitting layer for emitting red light, a green pixel G-PX may include a green light emitting layer for emitting green light, and a blue pixel B-PX may include a blue light emitting layer for providing blue light.

The organic light emitting layer LD may selectively further include a Hole Transport Layer ("HTL"), a Hole Injection Layer ("HIL"), an Electron Transport Layer ("ETL"), and/or an Electron Injection Layer ("EIL"), which are disposed on and/or under the light emitting layer EML.

Figure 14:
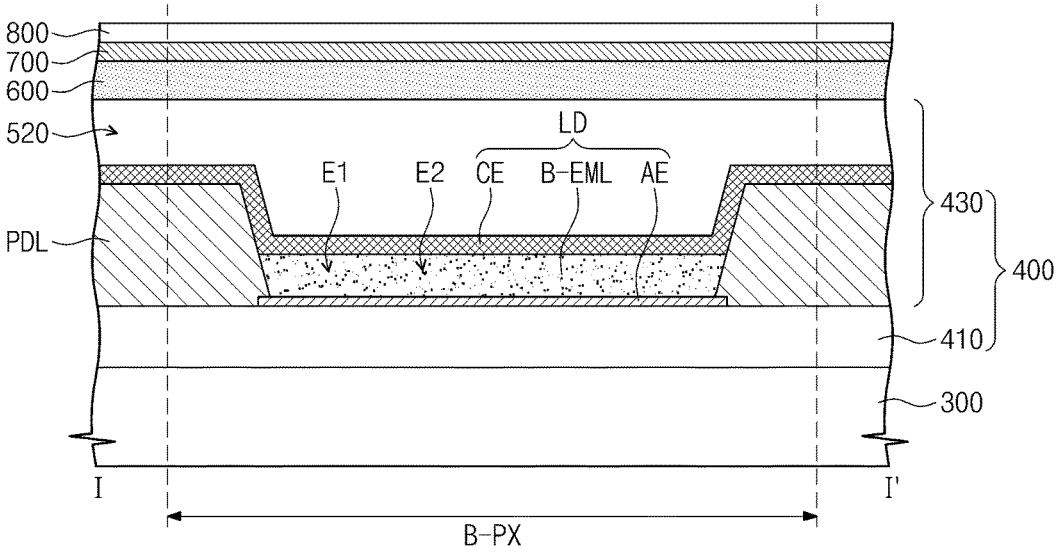
FIG. 14 is a sectional view of a blue pixel shown in FIG. 12.

FIG. 14 is a sectional view of a blue pixel shown in FIG. 12. Hereinafter, a blue light emitting layer B-EML will be described in more detail with reference to FIG. 14.

The blue light emitting layer B-EML may include a first organic light emitting material E1 for emitting first color light and a second organic light emitting material E2 for emitting second color light.

In an exemplary embodiment, a peak wavelength of light emitting from the first organic light emitting material E1 may be about 390 nm to about 410 nm and a half width may be about 17 nm to about 25 nm, for example. Herein, the color of the first color light may be purple, for example.

In an exemplary embodiment, a peak wavelength of light emitting from the second organic light emitting material E2 may be about 480 nm to about 491 nm and a half width may be about 17 nm to about 23 nm, for example. Herein, the color of the second color light may be cyan, for example.

As shown in FIG. 14, the blue light emitting layer B-EML may be provided as a single layer. The first organic light emitting material E1 and the second organic light emitting material E2 may be mixed and disposed in the blue light emitting layer B-EML.

As the first organic light emitting material E1 and the second organic light emitting material E2 are mixed and disposed, light emitting from the blue light emitting layer B-EML may be mixed with the first color light and the second color light and seen as a blue light.

The organic light emitting device layer 430 may further include a pixel definition layer PDL disposed on the driving device layer 410. The pixel definition layer PDL may be disposed overlapping the boundary of the pixel areas PA of FIG. 12 on the plane.

A sealing layer 600 may be disposed on the pixel layer 400. The sealing layer 600 may cover the display area DA (refer to FIG. 12). A sealing layer 600 may include an organic layer or an inorganic layer. However, an exemplary embodiment of the invention is not limited thereto and the sealing layer may be provided as a substrate including glass or plastic.

The display device DD-1 may further include the sealing member 310 of FIG. 12. The sealing member 310 may be disposed to surround the display area DA and contact the substrate 300 and the sealing layer 600. The sealing member 310 together with the sealing layer 600 may prevent the organic light emitting device LD from being exposed to the external moisture and air.

An inner space 520 provided by the pixel layer 400, the sealing layer 600, and the sealing member 310 may be provided in a vacuum but an exemplary embodiment of the invention is not limited thereto. In an exemplary embodiment, the inner space 520 may be filled with nitrogen (N2) or a filling material including an insulation material.

The display device DD-1 may further include a polarizing plate 800 and an adhesive layer 700. The polarizing plate 800 may circularly polarize incident light. The adhesive layer 700 may adhere between the sealing layer 600 and the polarizing plate 800.

Figure 15:
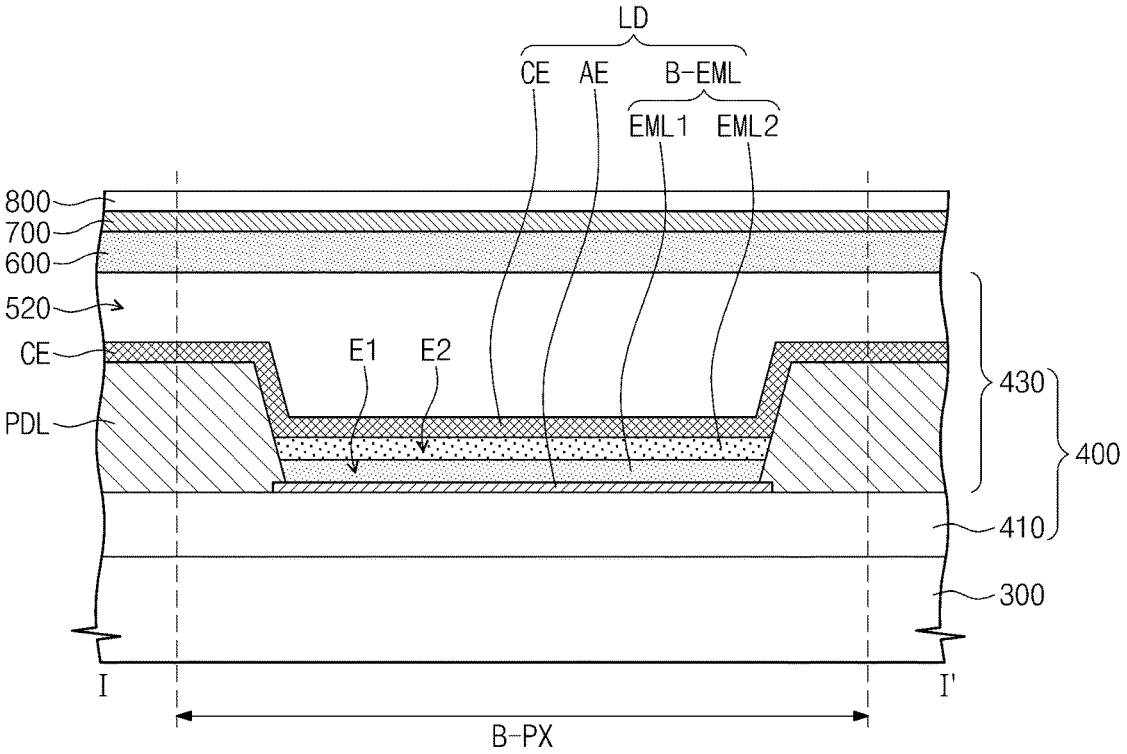
FIG. 15 is a sectional view of another embodiment of a blue pixel according to the invention.

FIG. 15 is a sectional view of a blue pixel according to another embodiment of the invention. For convenience of description, description focuses on the differences from the above described exemplary embodiment of the invention and omitted parts follow the embodiment of the invention.

Referring to FIG. 15, a blue light emitting layer B-EML may include a plurality of layers.

The blue light emitting layer B-EML may include a first light emitting layer EML1 including a first organic light emitting material E1 for emitting first color light and a second light emitting layer EML2 including a second organic light emitting material E2 for emitting second color light. Although it is shown in FIG. 15 that the second light emitting layer EML2 is disposed on the first light emitting layer EML1, its stacking order is not limited thereto.

In an exemplary embodiment, a peak wavelength of light emitting from the first organic light emitting material E1 may be about 390 nm to about 410 nm and a half width may be about 17 nm to about 25 nm, for example. Herein, the first color light may be purple, for example.

In an exemplary embodiment, a peak wavelength of light emitting from the second organic light emitting material E2 may be about 480 nm to about 491 nm and a half width may be about 17 nm to about 23 nm, for example. Herein, the second color light may be cyan, for example.

Light emitted from the first light emitting layer EML1 and light emitted from the second light emitting layer EML2 may be mixed and seen as a blue light.

Figure 16:
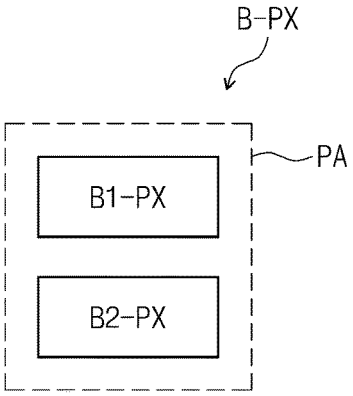
FIG. 16 is a plan view of another embodiment of a blue pixel according to the invention.
Figure 17:
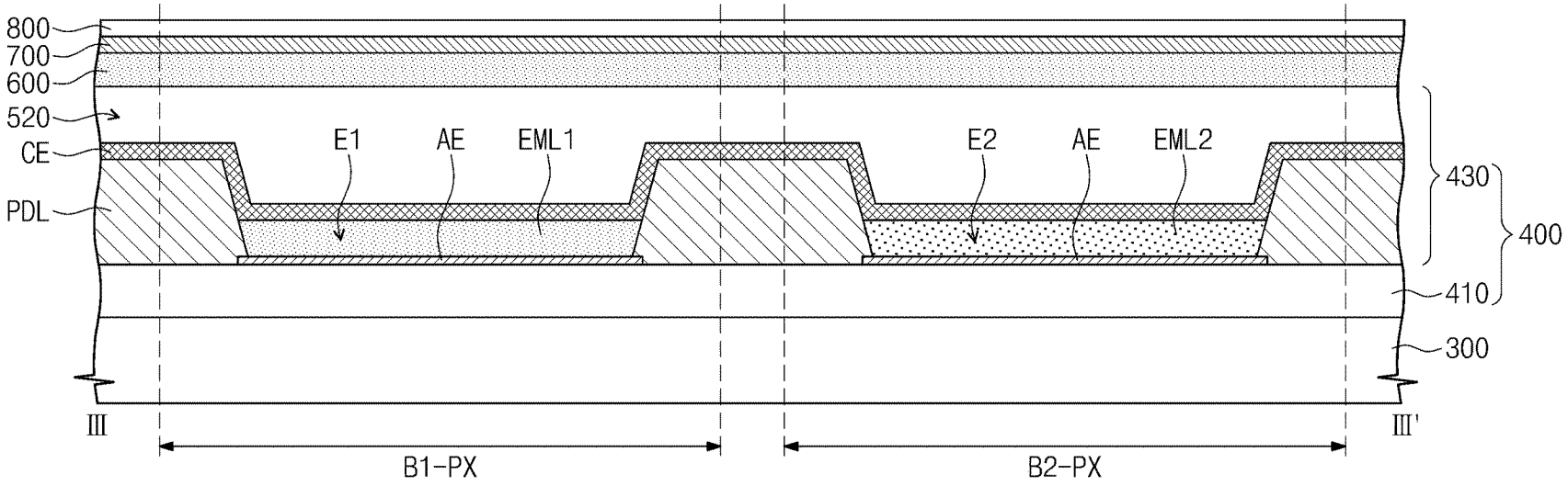
FIG. 17 is a sectional view of a blue pixel shown in FIG. 16.

FIG. 16 is a plan view illustrating a blue pixel according to another embodiment of the invention and FIG. 17 is a sectional view of the blue pixel shown in FIG. 16.

Referring to FIGS. 16 and 17, according to another exemplary embodiment of the invention, the blue pixel B-PX may include a first sub pixel B1-PX and a second sub pixel B2-PX, which are adjacent to each other in one pixel area PA. The first sub pixel B1-PX and the second sub pixel B2-PX may have a smaller area than that of the red pixel R-PX and/or that of the green pixel G-PX (refer to FIG. 12).

The first sub pixel B1-PX includes a first light emitting layer EML1 including a first organic light emitting material E1 for emitting first color light. In an exemplary embodiment, a peak wavelength of light emitting from the first organic light emitting material E1 may be about 390 nm to about 410 nm and a half width may be about 17 nm to about 25 nm, for example. Herein, the first color light may be purple, for example.

The second sub pixel B2-PX includes a second light emitting layer EML2 including a second organic light emitting material E2 for emitting second color light. In an exemplary embodiment, a peak wavelength of light emitting from the second organic light emitting material E2 may be about 480 nm to about 491 nm and a half width may be about 17 nm to about 23 nm, for example. Herein, the second color light may be cyan, for example.

Light emitted from the first light emitting layer EML1 and light emitted from the second light emitting layer EML2 may be mixed and seen as a blue light.

The first sub pixel B1-PX and the second sub pixel B2-PX may be turned on during a single frame section. Additionally, the first sub pixel B1-PX and the second sub pixel B2-PX may be sequentially driven during a single frame section.

According to an exemplary embodiment of the invention, a display device may protect the eyesight and maintain the display quality.

The above-disclosed subject matter is to be considered illustrative and not restrictive, and the appended claims are intended to cover all such modifications, enhancements, and other embodiments, which fall within the true spirit and scope of the invention. Thus, to the maximum extent allowed by law, the scope of the invention is to be determined by the broadest permissible interpretation of the following claims and their equivalents, and shall not be restricted or limited by the foregoing detailed description.

What is claimed is:

1. A display device comprising:

a driving unit which outputs a driving signal; and a display panel which displays an image with at least one of a red light, a green light, and a blue light in response to the driving signal, wherein the blue light comprises a first color light and a second color light; and a peak wavelength of the first color light is about 390 nanometers to about 410 nanometers and a peak wavelength of the second color light is about 480 nanometers to about 491 nanometers.

2. The display device of claim 1, wherein a half width of the first color light is about 17 nanometers to about 25 nanometers.

3. The display device of claim 2, wherein a half width of the second color light is about 17 nanometers to about 23 nanometers.

4. The display device of claim 3, further comprising a light source unit which is disposed under the display panel and provides a light to the display panel.

5. The display device of claim 4, wherein the light source unit comprises a first light source which emits the red light, a second light source which emits the green light, and a third light source which provides the blue light.

6. The display device of claim 5, wherein the third light source comprises a first light emitting diode which emits the first color light and a second light emitting diode which emits the second color light.

7. The display device of claim 6, wherein the display panel displays the image corresponding to one screen by a frame unit;

the frame unit comprises sequentially-divided first to third sub frames; and the first light source is turned on during the first sub frame, the second light source is turned on during the second sub frame, and the third light source is turned on during the third sub frame.

8. The display device of claim 7, wherein the third sub frame comprises sequentially-divided first and second sub fields; and the first light emitting diode is turned on during the first sub field and the second light emitting diode is turned on during the second sub field.

9. The display device of claim 7, wherein each of the first light emitting diode and the second light emitting diode is turned on during the third sub frame.

10. The display device of claim 6, wherein the display panel displays the image corresponding to one screen by a frame unit; and each of the first to third light sources is turned on during the frame unit.

11. The display device of claim 10, wherein each of the first light emitting diode and the second light emitting diode is turned on during the frame unit.

12. The display device of claim 10, wherein the frame unit comprises sequentially-divided third and fourth sub fields; and the first light emitting diode is turned on during the third sub field and the second light emitting diode is turned on during the fourth sub field.

13. The display device of claim 4, wherein the light source unit comprises a first light source which emits the red light, a second light source which emits the green light, a third light source which emits the first color light, and a fourth light source which emits the second color light.

14. The display device of claim 4, wherein the display panel comprises a red pixel which displays a red image, a green pixel which displays a green image, and a blue pixel which displays a blue image, wherein the red pixel comprises a red light emitting layer which emits the red light, the green pixel comprises a green light emitting layer which emits the green light, and the blue pixel comprises a blue light emitting layer which provides the blue light.

15. The display device of claim 14, wherein the blue light emitting layer comprises a first organic light emitting material which emits the first color light and a second organic light emitting material which emits the second color light.

16. The display device of claim 15, wherein the blue light emitting layer is provided as a single layer, and the first organic light emitting material and the second organic light emitting material are mixed and disposed at the blue light emitting layer.

17. The display device of claim 15, wherein the blue light emitting layer comprises a first light emitting layer and a second light emitting layer disposed on the first light emitting layer; and the first organic light emitting material is disposed at the first light emitting layer and the second organic light emitting material is disposed at the second light emitting layer.

18. The display device of claim 14, wherein the blue pixel comprises a first sub pixel and a second sub pixel disposed adjacent to each other.

19. The display device of claim 18, wherein the first sub pixel and the second sub pixel are provided with a smaller area than that of the red pixel and that of the green pixel.

20. A display device comprising:

a driving unit which outputs a driving signal; and a display panel which displays an image with a red light, a green light, a first color light, and a second color light sequentially provided in response to the driving signal, wherein a peak wavelength of the first color light is about 390 nanometers to about 410 nanometers, a peak wavelength of the second color light is about 480 nanometers to about 491 nanometers, and the first color light and the second color light are mixed and seen as a blue light.

* * * * *